US005986612A

United States Patent [19]

Nagy

[11] Patent Number: 5,986,612

[45] Date of Patent: Nov. 16, 1999

[54] VEHICLE WINDOW ANTENNA

[75] Inventor: Louis Leonard Nagy, Warren, Mich.

[73] Assignees: General Motors Corporation, Detroit; Delphi Technologies, Inc., Troy, both of Mich.

[21] Appl. No.: 08/773,919

[22] Filed: Dec. 30, 1996

[51] Int. Cl.[6] ..... H01Q 1/32

[52] U.S. Cl. ..... 343/713; 343/846

[58] Field of Search ..... 343/711, 712, 343/713, 829, 846, 704, 715; H01Q 1/32, 1/38, 9/38

[56] References Cited

U.S. PATENT DOCUMENTS

| | | | |
|---|---|---|---|
| 3,646,561 | 2/1972 | Clarke | 343/711 |
| 5,293,174 | 3/1994 | Kropielnicki et al. | 343/713 |
| 5,353,039 | 10/1994 | Tsukada et al. | 343/713 |

*Primary Examiner*—Don Wong
*Assistant Examiner*—Tho Phan
*Attorney, Agent, or Firm*—George A. Grove; Robert M. Sigler

[57] ABSTRACT

A vehicle window antenna comprises a grid of conductive frit material affixed to the inner side of a window glass in a confined area above a window heating element comprising a grid of similar material similarly affixed and covering most of the window viewing area. The window glass is retained in a channel surrounding an aperture edge of the vehicle body by a mounting and sealing member comprising a strip of a urethane material which is electrically conductive with a low impedance at radio frequencies. At least one electrically conducting ground element, made of the same frit material, is affixed to the inner side of the window glass and electrically coupled at radio frequencies through the mounting and sealing member to the vehicle body. The ground element is provided at the point where the antenna element most closely approaches the mounting and sealing member and aperture edge and has an inner edge extending sufficiently close to the antenna element, as compared with the mounting and sealing element, to replace the latter in defining the closest distance between the ground plane and the antenna element and thus provides a predetermined antenna impedance or other antenna parameter regardless of variations in position, configuration and dimension of the mounting and sealing element. The ground element may be located at one of the upper corners of the antenna element and may comprise a generally L shaped element between the antenna element and the upper corner with a horizontal portion and a vertical portion, the latter extending along the side of the antenna element. The antenna may also comprise a similar ground element adjacent the other upper corner of the antenna element.

6 Claims, 2 Drawing Sheets

VEHICLE WINDOW ANTENNA

TECHNICAL FIELD

The technical field of this invention is vehicle window antennas.

BACKGROUND OF THE INVENTION

A vehicle window antenna currently in use on motor vehicles, as seen in FIG. 1, has an antenna element 2 comprising a grid of electrically conductive frit material affixed to the inner side of a vehicle rear window glass 3 and an electrically conductive rear defogger or heating element 4 comprising a grid made of the same electrically conductive frit material and affixed to the inner side of the rear window glass below the antenna element. The window glass is retained on a vehicle body 5 to cover a window aperture defined by an aperture edge 6 of body 10, which edge is overlapped by window glass 3. The antenna and heater elements are not directly connected to each other but are spaced from each other such that the defogger element is coupled to the antenna element to be driven thereby as a parasitic antenna element. Since the heating element covers most of the viewing area of the window glass, the antenna element is confined to a small upper portion of the window glass adjacent the top and upper side portions of aperture edge 6.

Window glass 3 is held on body 10 by a mounting and sealing member, not shown, which is laid in a recessed channel formed in the vehicle body adjacent the aperture edge. The member comprises a strip of urethane material having electrically conducting properties at radio frequencies due to its dielectric constant and to electrically conductive particles included therein to provide a black color. At least a portion of the active antenna element must be sufficiently near a ground plane provided by the vehicle body to be coupled therewith; and this is accomplished in the prior art by providing a portion of the active antenna element on the inner side of the window glass near the top and upper side edges of the vehicle body aperture. Due to the facts that the mounting and sealing member (1) is very near the aperture edge in the vehicle body, (2) separates the plane of the antenna element on the window glass from that of the aperture edge, and (3) is electrically conductive at radio frequencies, it generally provides a low impedance extension of the vehicle body ground plane and comprises the closest portion of the ground plane to the antenna.

The distance between the antenna element and ground plane significantly affects the antenna impedance; and the smallest distance between the antenna element and the ground plane dominates that affect. It is thus important to control the smallest distance between the antenna and the ground plane precisely to maintain a predetermined antenna impedance. However, the mounting and sealing member is subject to a plurality of variables during the vehicle assembly process which can lead to a variation of this distance. It is generally applied by laying a bead of the urethane material in a strip around the aperture edge; and the precise path of the bead and amount of material per unit distance can vary around a single window as well as from vehicle to vehicle. The bead is easily deformable until cured; and the window glass is laid in the channel and pressed down on the mounting and sealing member, which causes the bead of material to flatten and widen. The pressure applied to the window glass may vary, which results in a variable width and height of the member. The window glass may be laid slightly out of position and moved sideways into a better position, in which case the bead may be distorted into a slanted cross-sectional shape as the top is moved by its contact with the window glass sideways with respect to the bottom. It is thus difficult in a mass assembly environment to control the final position and configuration of the mounting and sealing member with the precision required to guarantee that the closest distance between the antenna element and the vehicle body ground plane, as extended by the mounting and sealing member, will not vary from that designed to provide the predetermined antenna impedance.

SUMMARY OF THE INVENTION

The antenna of this invention is an improvement of the antenna described above with the addition of at least one electrically conducting ground element affixed to the inner side of the window glass and electrically coupled at radio frequencies through the mounting and sealing member to the vehicle body. The ground element has an inner edge extending sufficiently close to the antenna element, as compared with the mounting and sealing element, to replace the latter in defining the closest distance between the ground plane and the antenna element and thus provides a predetermined antenna impedance or other antenna parameter regardless of variations in position, configuration and dimension of the mounting and sealing element.

Preferably, the antenna element most closely approaches the aperture edge at the upper corners, and the ground element comprises a generally L shaped element between the antenna element and one of the upper corners, the L shaped element having a horizontal portion and a vertical portion. The antenna may also comprise a similar ground element adjacent the other of the upper corners.

DESCRIPTION OF THE PREFERRED EMBODIMENT

Figure 2:
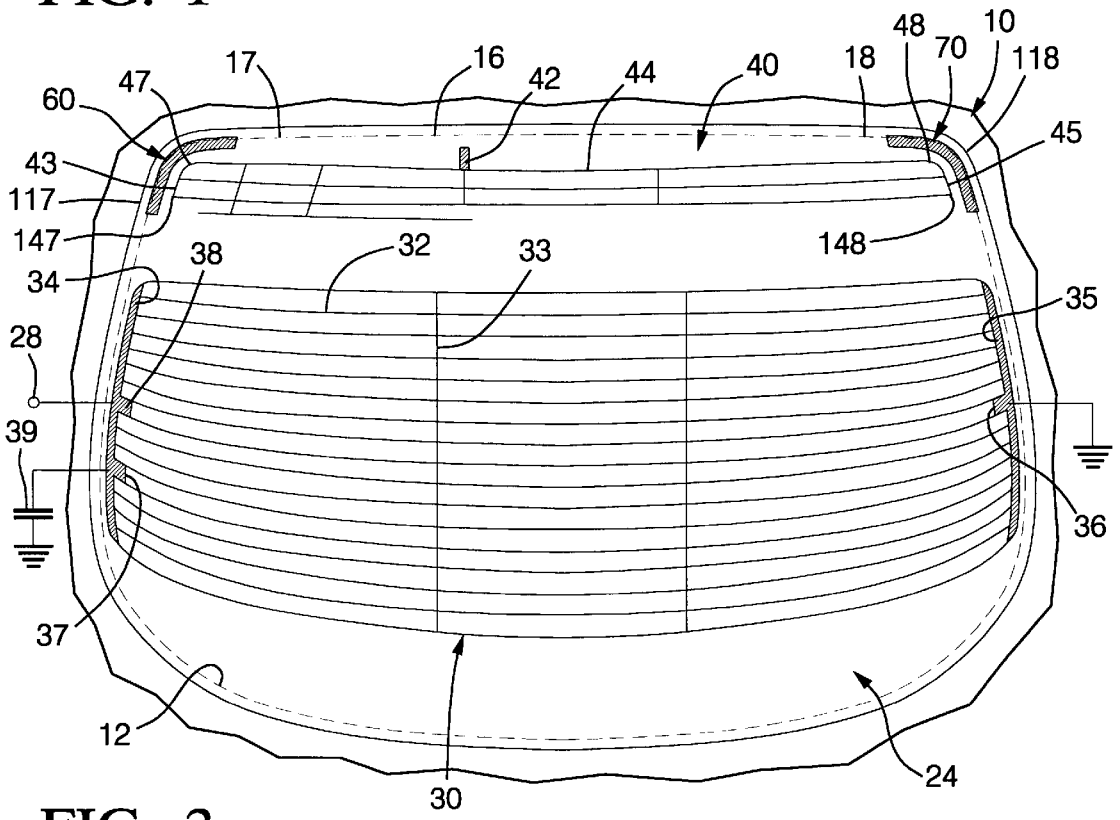
FIG. 2 shows a preferred embodiment of a portion of a vehicle body having a window antenna according to the invention.
Figure 3:
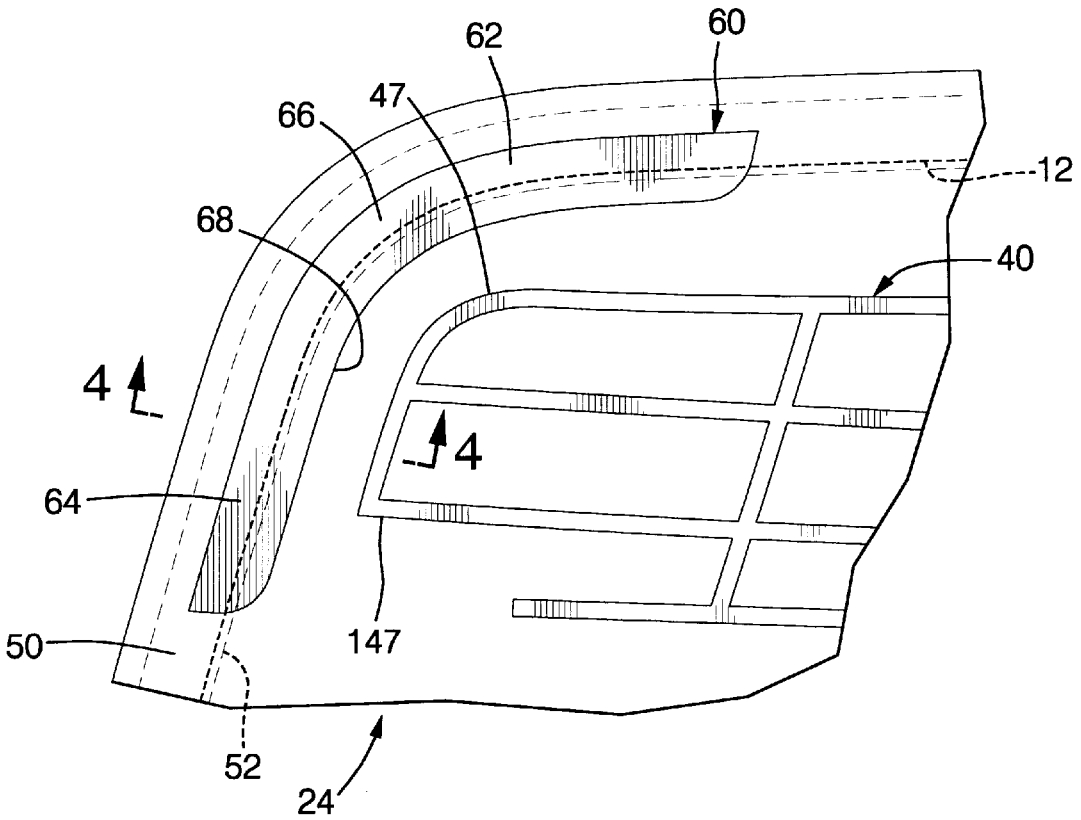
FIG. 3 shows an enlarged, close up view of a portion of the embodiment of FIG. 2.
Figure 4:
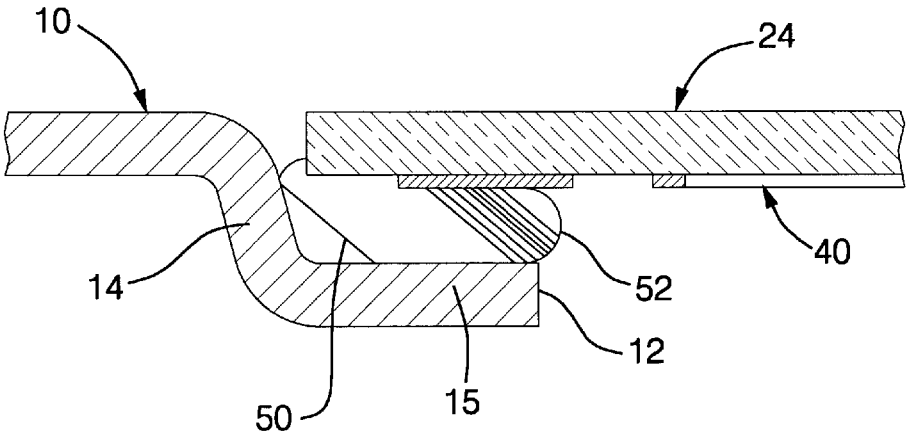
FIG. 4 shows a section view along lines 4—4 in FIG. 3.

Referring to FIGS. 2–4, a vehicle body 10 has an aperture edge 12 defining a window aperture for the vehicle—the rear window in this embodiment. The vehicle body around aperture edge 12 comprises an inwardly bent section 14 and a flange 15, seen in FIG. 4, the free end of the latter defining aperture edge 12. Section 14 and flange 15 provide a recessed channel to receive a window glass 24, which is held in place by a mounting and sealing member 50 therebetween, as seen in FIG. 4. Mounting and sealing member 50 holds window glass 24 in the channel of section 14 and flange 15 to overlap flange 15 around its entire periphery and thus completely close the window aperture defined by aperture edge 12.

Window glass 24 is shown in its entirety in FIG. 2. A defogging element comprising a heating grid 30 of electrically conducting frit material is affixed to the inner side (with respect to the vehicle) of window glass 24 and extends over most of the viewing area thereof. The grid comprises thin horizontal 32 and vertical 33 heating sections and wider current distributing portions 34, 35 with connecting tabs on each side. The grid is activated by applying vehicle battery voltage through a terminal 28 to a connecting tab 38 on one side while grounding the connecting tab 36 on the other side. A second connecting tab 37 on the same side as tab 38 is grounded at radio frequencies through a capacitor 39. Such heating elements are well known in the prior art and common on vehicles.

An antenna element 40 comprises a grid affixed to the inner side of window glass 24 and preferably made of the same frit material as that used for heating grid 30. A connecting tab 42 is provided for feed connection of antenna element 40 to a radio receiver through, for example, a standard co-axial cable having a center, signal wire connected to tab 42 and an outer, ground wire connected to the vehicle body in a normal manner well known to those of ordinary skill in the art, as shown, for example in U.S. Pat. No. 5,528,314, Transparent Vehicle Window Antenna, issued to Louis L. Nagy et al on jun. 18, 1996. Antenna element 40 is horizontally elongated and is situated above heating grid 30 on the window glass. Although a significant space exists between antenna element 40 and heating grid 30 and the two are not directly connected, the latter is electromagnetically coupled to the former sufficiently to act as a parasitic antenna element. Thus, variations in the design of heating grid 30 may be used to help control the impedance and/or other electrical parameters of antenna of this invention.

The antenna of this embodiment is an AM/FM radio antenna, and the horizontal length of antenna element 40 is about 100 cm—somewhat greater than one quarter wavelength in the center of the FM radio frequency band which is centered on a wavelength of approximately 3.0 meters. The antenna is designed to be most closely coupled to the ground plane at the horizontal ends and must therefore extend mostly across the width of the upper portion of the window glass, even if this width is greater than one quarter wavelength. In fact, with multiple current paths in the grid, a plurality of resonant frequencies exist—some approaching one half wavelength in the FM radio frequency band.

A top edge 44 and side edges 43 and 45 of antenna element 40 are placed sufficiently close to the aperture edge 12 of vehicle body 10 that the body provides a ground plane for the antenna of this invention. In this embodiment, aperture edge 12 has a top portion 16 with upper corners 17, 18 at each end and a slightly convex arc between the corners. Antenna element 40 is generally rectangular in shape adjacent the top portion of aperture edge 12; and top edge 44 of antenna element 40 has upper corners 47, 48 at each end thereof located adjacent upper corners 17, 18, respectively, of aperture edge 12 and lower corners 147 and 148 located adjacent upper vertical side portions 117 and 118, respectively, of aperture edge 12. Due to the size and location of antenna element 40 and the upward arc of top portion 16 of aperture edge 12, which is not matched by top edge 44 of antenna element 40, upper corners 47 and 48 and the ends of antenna element 40 between upper corner 47 and lower corner 147 and between upper corner 48 and lower corner 148 provide the smallest distance between antenna element 40 and aperture edge 12 of vehicle body 10.

Mounting and sealing member 50 is preferably a urethane material which is applied in a deformable state as an extended bead around aperture edge 12 in the channel formed by section 14 and flange 15 but becomes less deformable as it cures. Although nominally applied in a constant amount per unit distance and at a predetermined distance from aperture edge 12, production variables may slightly vary this amount and distance. Window glass 24, with heating element 30 and antenna element 40 already applied, is laid in the channel and pressed down onto member 50, which retains window glass 24 and thus affixes it to body 10. Member 50 is not yet completely cured; and it is compressed by window glass 24, with its height decreasing and its lateral width increasing. These changes are subject to variation, on a single vehicle and from one vehicle to another, as a result of non-uniform pressure on the window glass. In addition, the window glass may be moved slightly laterally after it has been laid on and attached to the top of member 50; and this may introduce a cross-sectional skew or slant to the member.

A possible cross-sectional appearance of member 50 is seen in FIG. 4. In this embodiment, the inner lateral edge 52 of member 50 extends beyond aperture edge 12 of body 10. This represents one extreme of possible positions of inner lateral edge 52 and emphasizes that it is closer to antenna 40 than is aperture edge 12. It would also be closer if it were aligned with aperture edge 12 or even if it were slightly short of aperture edge 12, since aperture edge 12 is also separated vertically, as seen in FIG. 4, from antenna 40 on the inner surface of window glass 24. If member 50 is shorter laterally, it is generally because of lower pressure on window glass 24 in installation, which will also tend to produce a greater vertical distance between antenna 40 on window glass 24 and aperture edge 12. Thus, most variations in the lateral extension of member 50 would vary the distance between antenna 40 and the ground plane of body 10 and thus the impedance of the antenna if member 50 provided the shortest distance between antenna 40 and the ground plane of body 10.

Figure 1:
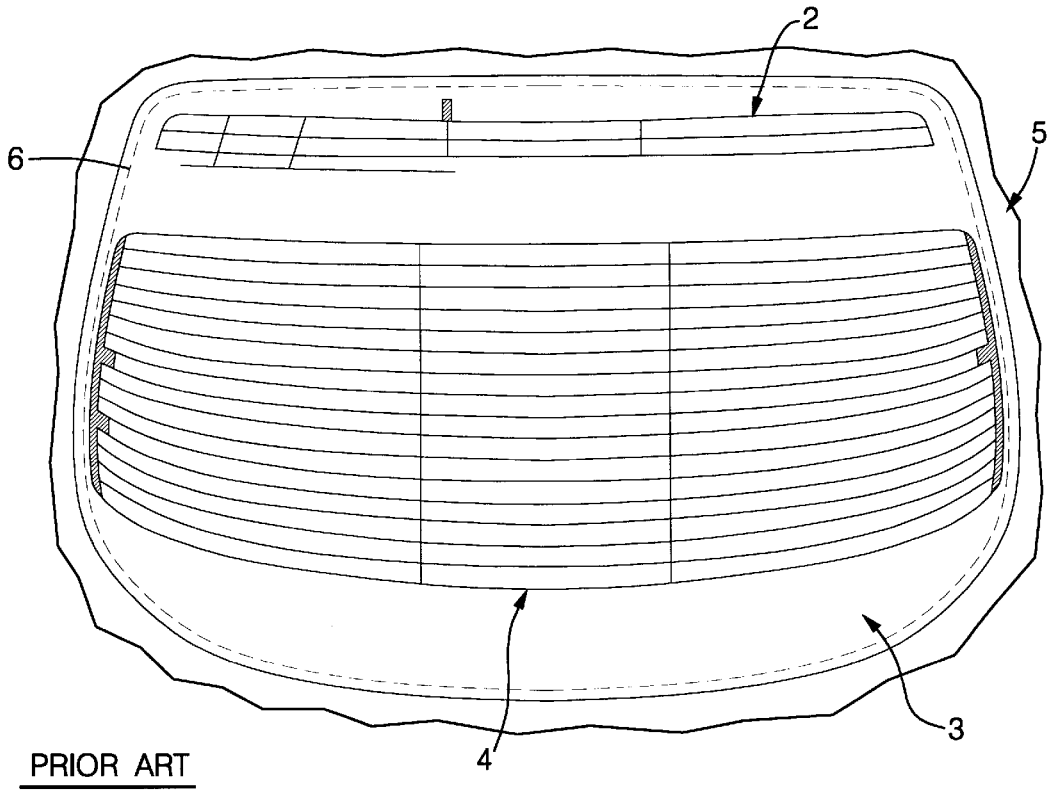
PRIOR ART FIG. 1
FIG. 1 shows a portion of a vehicle body having a window antenna of the prior art.

To eliminate such variations and establish a predetermined antenna impedance, the antenna is modified from that of the prior art seen in FIG. 1 by the addition of one or more ground elements on the inner side of window glass 24 adjacent antenna element 40 in the location(s) of minimum distance between antenna element 40 and aperture edge 12. In this embodiment, ground elements 60 and 70 are provided at the upper corners 47 and 48, respectively, of antenna element 40. Ground elements 60 and 70 are made of the same frit material as are heating grid 30 and antenna element 40. Ground element 60 is shown enlarged in FIG. 3. It is generally L-shaped, with a total length of about 185 mm and a width of about 15 mm. It comprises a horizontal portion 62 and a vertical portion 64 joined in a smooth curve in a corner 66. It is, over its total length, laterally overlapped by and in contact with member 50, which provides electrical conduction at radio frequencies with vehicle body 10, and thus comprises a low impedance extension, through member 50, of the ground plane. Its inner edge 68 is spaced from antenna element 40 by a predetermined distance of 15 mm along most of vertical portion 62 and corner 66, although the spacing grows gradually to more than 20 mm along horizontal portion 64 to its free end as horizontal portion follows member 50 and the arc of the top portion of aperture edge 12. The spacing of inner edge 68 from the edge of window glass 24 is about 25 mm so that it is significantly closer to antenna element 40 than aperture edge 12 and slightly closer to antenna element 40 than inner edge 52 of member 50 at the latter's greatest expected lateral spread. Especially since it is also on the inner surface of window glass 24—in the same horizontal plane as antenna element 40—it is closer, over its own length, than either aperture edge 12 or member 50 to antenna element 40. Ground element 70 is similarly provided adjacent the other upper corner 48 of antenna element 40. Since ground elements 60 and 70 are placed in the regions where aperture edge 12 and member 50 most closely approach antenna element 40, they define the shortest distance between antenna element 40 and the ground plane of vehicle body 10 and thus dominate the control of antenna impedance. The distance between antenna element 40 and the ground plane of body 10 is significantly greater in regions where this distance is controlled by member 50 rather than ground elements 60 and 70; and variations in this distance in those regions have a much smaller affect. Ground elements 60 and 70 thus greatly decrease variations in antenna impedance associated with production variations in the assembly of member 50 and window glass 24 on body 10.

I claim:

1. In a vehicle body having an aperture edge defining a window aperture and a window glass supported by a urethane sealing and supporting member in a recessed channel of the vehicle body surrounding the aperture edge, the window glass having an electrically conducting antenna grid affixed thereto and tuned for reception at a commercial FM band wavelength of 3.0 meters, the vehicle body forming a ground plane for the antenna grid with at least one antenna parameter determined by the smallest distance between the antenna grid and the ground plane and the urethane sealing and supporting member having electric properties providing electric coupling at the commercial FM band wavelength, the urethane sealing and supporting member being subject to variations in position, configuration or dimension within the channel which can potentially extend the ground plane of the vehicle body past the aperture edge toward the antenna and thus unpredictably affect the closest distance between the ground plane and the antenna grid, the improvement comprising:

an electrically conducting ground extension element affixed to the window glass between the antenna grid and the vehicle body and electrically coupled at the commercial FM band wavelength through the urethane sealing and supporting member to the vehicle body, the ground extension element having an edge extending closer to the antenna grid than any portion of the urethane sealing and supporting member so as to define and control the closest distance between the ground plane and the antenna grid regardless of variations in position, configuration or dimension of the urethane sealing and supporting member.

2. The improvement of claim 1 in which the aperture edge has a top portion with an upper corner at each end thereof, the antenna grid most closely approaches the aperture edge at the upper corners, and the ground extension element comprises a generally L shaped member between the antenna grid and one of the upper comers, the L shaped member having a horizontal portion and a vertical portion, the latter extending along a side of the antenna grid.

3. The improvement of claim 2 in which the ground extension element comprises another generally L shaped member between the antenna grid and the other of the upper corners, the another L shaped member also having a horizontal portion and a vertical portion, the latter extending along the other side of the antenna grid.

4. The improvement of claim 1 in which the antenna parameter is antenna impedance.

5. The improvement of claim 4 in which the aperture edge has a top portion with an upper corner at each end thereof, the antenna grid most closely approaches the aperture edge at the upper corners, and the ground extension element comprises a generally L shaped member between the antenna grid and one of the upper corners, the L shaped member having a horizontal portion and a vertical portion, the latter extending along a side of the antenna grid.

6. The improvement of claim 5 in which the ground extension element comprises another generally L shaped member between the antenna grid and the other of the upper corners, the another L shaped member also having a horizontal portion and a vertical portion, the latter extending along the other side of the antenna grid.

* * * * *